US008397621B2

(12) United States Patent
Hodge

(10) Patent No.: US 8,397,621 B2
(45) **Date of Patent: *Mar. 19, 2013**

(54) REMOTELY CONTROLLED FIREARM MOUNT

(76) Inventor: Darron Hodge, Poplarville, MS (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/543,205

(22) Filed: Jul. 6, 2012

(65) Prior Publication Data

US 2012/0266746 A1 Oct. 25, 2012

Related U.S. Application Data

(63) Continuation of application No. 12/461,211, filed on Aug. 5, 2009, now Pat. No. 8,234,968.

(51) Int. Cl.
*F41G 5/06* (2006.01)

(52) U.S. Cl. ..... 89/41.05; 89/37.17; 89/41.02

(58) Field of Classification Search ..... 89/37.01, 89/37.17, 41.01, 41.02, 41.05; 235/404, 235/407, 411

See application file for complete search history.

(56) References Cited

U.S. PATENT DOCUMENTS

| | | | | |
|---|---|---|---|---|
| 1,821,521 | A | 9/1931 | Mackine | |
| 2,231,149 | A | 2/1941 | Frank | |
| 2,282,680 | A | 5/1942 | Sonne | |
| 2,352,577 | A | 6/1944 | Veit | |
| 2,587,687 | A | 3/1952 | Beyers | |
| 2,642,662 | A | 6/1953 | Lyon | |
| 3,309,962 | A | 3/1967 | Lykam | |
| 3,828,458 | A | 8/1974 | Skone-Palmer | |
| 4,012,860 | A | 3/1977 | Auger | |
| 5,272,955 | A | 12/1993 | Bond et al. | |
| 5,599,187 | A | 2/1997 | Mesiano | |
| 5,949,015 | A | 9/1999 | Smith et al. | |
| 5,954,507 | A | 9/1999 | Rod et al. | |
| 6,237,462 | B1 | 5/2001 | Hwakes et al. | |
| 6,269,730 | B1 | 8/2001 | Hwakes et al. | |
| 6,338,218 | B1 | 1/2002 | Hegler | |
| 6,679,158 | B1 | 1/2004 | Hawkes et al. | |
| 6,871,440 | B2 | 3/2005 | Highfill et al. | |
| 7,036,639 | B2 | 5/2006 | Exely | |
| 7,047,863 | B2 | 5/2006 | Hawkes et al. | |
| 7,650,826 | B2 | 1/2010 | Son et al. | |
| 7,730,824 | B1 | 6/2010 | Black | |
| 7,926,220 | B2 | 4/2011 | Holmberg | |
| 7,974,736 | B2 | 7/2011 | Morin et al. | |
| 8,029,198 | B2 | 10/2011 | Ko | |
| 8,234,968 | B2 * | 8/2012 | Hodge | 89/41.05 |
| 2002/0174587 | A1 | 11/2002 | Ramfelt | |
| 2003/0145719 | A1 | 8/2003 | Friedli et al. | |
| 2004/0050240 | A1 | 3/2004 | Greene et al. | |
| 2004/0058562 | A1 | 3/2004 | Hwang et al. | |
| 2005/0263000 | A1 | 12/2005 | Hill | |
| 2006/0060026 | A1 | 3/2006 | Hawkes et al. | |
| 2006/0283316 | A1 | 12/2006 | Richeux | |
| 2007/0051235 | A1 | 3/2007 | Hawkes et al. | |
| 2007/0119296 | A1 | 5/2007 | Niv et al. | |
| 2008/0034954 | A1 | 2/2008 | Grober | |
| 2008/0110326 | A1 | 5/2008 | Sbrighi | |
| 2008/0115660 | A1 | 5/2008 | Hensel | |

(Continued)

*Primary Examiner* — Bret Hayes
*Assistant Examiner* — Joshua Freeman
(74) *Attorney, Agent, or Firm* — Maier & Maier PLLC

(57) ABSTRACT

A firearm mount including a base that supports a movable cradle within which is positioned a firearm. Remotely controlled motors turn the cradle about horizontal and vertical axes. Remote operation of the motors is enhanced by a video camera secured to the firearm and connected to a transmitter that broadcasts an electronic video signal to the user stationed away from the mount. The trigger of the firearm in the cradle is moved to fire by a remotely controlled solenoid.

11 Claims, 5 Drawing Sheets

U.S. PATENT DOCUMENTS

| | | | |
|---|---|---|---|
| 2009/0025545 | A1 | 1/2009 | Persson et al. |
| 2009/0139393 | A1 | 6/2009 | Quinn |
| 2009/0205238 | A1 | 8/2009 | Willis, Jr. |
| 2009/0246976 | A1 | 10/2009 | Niitsu et al. |
| 2010/0212482 | A1 | 8/2010 | Morin |
| 2010/0263524 | A1 | 10/2010 | Morin |
| 2011/0045690 | A1 | 2/2011 | Pevoteaux et al. |

* cited by examiner

REMOTELY CONTROLLED FIREARM MOUNT

RELATED APPLICATIONS

This application is a continuation of U.S. patent application Ser. No. 12/461,211, filed Aug. 5, 2009, the disclosures of which are incorporated by reference herein in their entireties.

FIELD OF THE INVENTION

The present invention relates generally to ordnance and, more particularly, to motor-operated mounts controlled by television monitoring.

BACKGROUND OF THE INVENTION

While stalking prey, hunters usually employ some sort of camouflage in order to avoid detection. To this end, numerous garments, scents, screens, blinds, tree stands, and other structures have been proposed to conceal the presence of a hunter. Unfortunately, these products do an imperfect job of concealing a hunter since he remains vulnerable to being seen, heard, or smelled by game animals with acute senses while he is present in the field. It is simply impossible for a person to remain immobile or scent-free for during the hours required to complete some hunts. Camouflage has its limits and good, natural cover is frequently rare.

Thoughtful hunters have proposed remotely controlled weapons as a way to overcome some of the problems associated with camouflage. It is reasoned that by placing a hunter at a great distance from his weapon, the opportunities for taking effective shots at a game animal with the weapon are increased. The known, remotely controlled weapons, particularly those utilizing firearms, however, have been complicated in their construction, dangerous, and difficult to use. To date, remotely controlled firearms have not seen widespread commercial acceptance.

SUMMARY OF THE INVENTION

In light of the problems associated with discharging a firearm in a stealthy manner, it is my principal object to provide a mount for a firearm that can be remotely controlled to accurately aim and discharge the firearm. In fact, the firearm can be discharged while its barrel is being pivoted or elevated thereby permitting target tracking. Wireless operation of the mount permits the operator (whether a hunter, law enforcement officer, border patrol agent, or soldier) to position himself hundreds of yards away from his firearm at a safe location. The mount, standing by itself without a nearby operator, is not easily seen, has no smell, is quiet in its operation, and is virtually undetectable.

My firearm mount permits the operator to "see" a target through a scope mounted atop firearm. The mount features a camera positioned atop the firearm that captures focused light passing through the scope and, in response, generates a video signal stream that is broadcast to the operator for continuous viewing on a monitor. The mount also features an infrared light source and the preferred camera has an internal, infrared imager so as to permit the mount to be used at night.

My firearm mount is provided with supplemental cameras that point to the sides and rear of a firearm supported thereby so that unauthorized individuals cannot access the mount unobserved. The supplemental cameras operate like one positioned adjacent the scope and generate video signal streams that are broadcast to the operator for continuous viewing on a monitor. If someone approaches the mount without authority, an operator can immediately target the individual by aiming the firearm at him.

The mount can support virtually any firearm, offering universal attachment. A rifle, shotgun, machine gun, or pistol can be supported, aimed, and fired by the mount with minimal effort. Single shot, semi-automatic, and automatic firearms can also be accommodated by my mount.

My firearm mount is lightweight, inexpensive, and portable. It can be carried by one man and set up by the same man with minimal training and with no additional tools. The device features a stand for positioning on the ground, but, with minor changes, the mount can be secured within the branches of a tree or affixed atop a vehicle.

My firearm mount is battery operated. After set-up, the mount can lay dormant indefinitely and can be awoken at a moment's notice for the aiming and discharging of a firearm. Perhaps the only reasons for an operator to return to the mount would be to reload the magazine or to transport the mount to a new location.

My firearm mount achieves the intended objects by featuring a base for positioning on a supporting surface. The base includes a base plate having a hole. A number of legs are affixed to, and extend downwardly from, the base plate. A journal bearing is affixed to the base plate and surrounds the hole. A mast is rotatably fastened by the journal bearing to the base plate. The mast has an upright tube with a top rising above the base plate and a bottom extending through the journal bearing. A first worm gear is affixed to the tube adjacent the journal bearing. A hinge is affixed to the top of the tube and has a pair of apertured tabs extending upwardly from the tube. A hinge pin extends between, and through, the tabs. The hinge pin is free to pivot within the tabs. A connecting rod is affixed to, and extends upwardly from, the hinge pin between the tabs. A second worm gear is affixed to the hinge pin remote from the connecting rod. A cradle, for supporting a firearm, has a walking beam that is affixed at its middle to the connecting rod. A pair of firearm support arms are affixed to, and extend upwardly from, the walking beam at spaced-apart locations. A remotely controlled solenoid, adapted for mounting on a firearm carried by the cradle, has an extensible plunger for moving the trigger of the firearm. A first video camera, adapted for mounting on a firearm carried by the cradle, produces a first electronic video signal. A transmitter is connected to the first video camera for broadcasting the first electronic video signal to a remote receiver. A first, remotely controlled motor is affixed to the base plate. The first motor has a first rotatable drive shaft extending therefrom. A first worm is affixed to the first rotatable drive shaft so as to smoothly mesh with the first worm gear whereby the rotation of the first rotatable drive shaft pivots the first worm gear and the mast. A second, remotely controlled motor is carried by the mast. The second motor has a second rotatable drive shaft extending therefrom. A second worm is affixed to the second rotatable drive shaft so as to smoothly mesh with the second worm gear whereby the rotation of the second rotatable drive shaft pivots the walking beam on the hinge.

The foregoing and other objects, features, and advantages of my firearm mount will become readily apparent upon further review of the following detailed description of the mount as illustrated in the accompanying drawings.

BRIEF DESCRIPTION OF THE DRAWINGS

My firearm mount is readily understood with reference to the accompanying drawings, in which.

Similar reference characters denote corresponding features consistently throughout the accompanying drawings.

DETAILED DESCRIPTION OF THE FIREARM MOUNT

Figure 1:
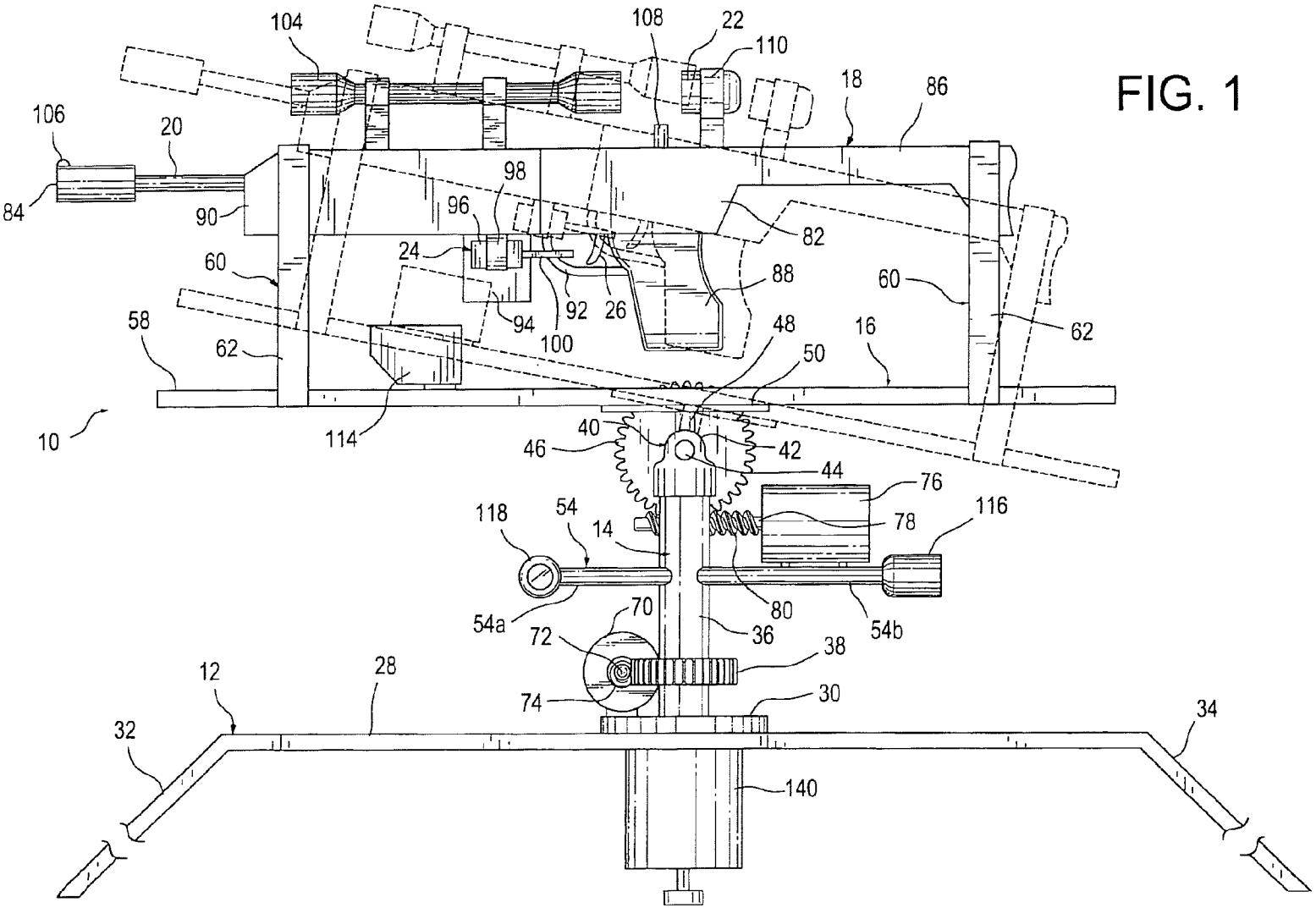
FIG. 1 is a side view of my remotely controlled mount supporting a firearm and having the firearm carriage portion thereof pivoted to an elevated orientation in broken lines.
Figure 2:
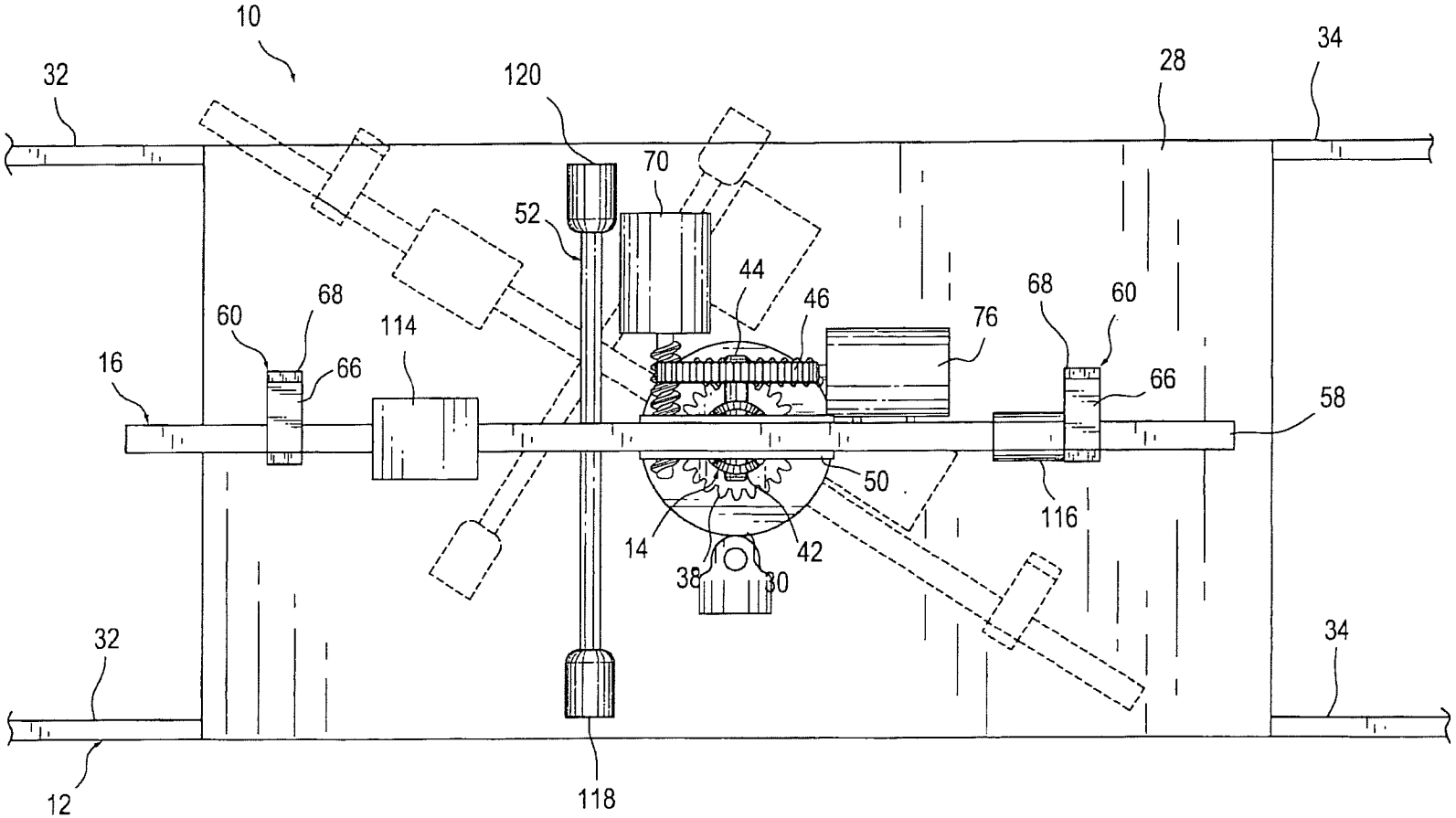
FIG. 2 is a top view of the firearm mount of FIG. 1.
Figure 3:
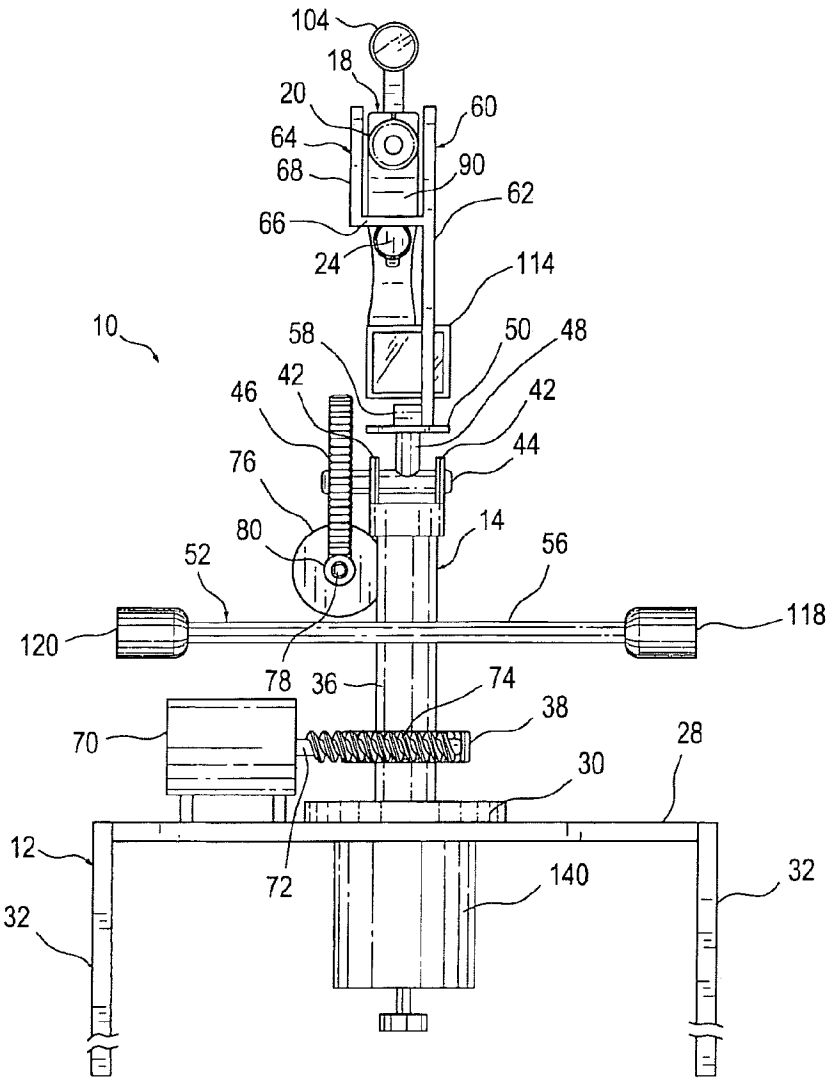
FIG. 3 is a front view of the firearm mount.
Figure 4:
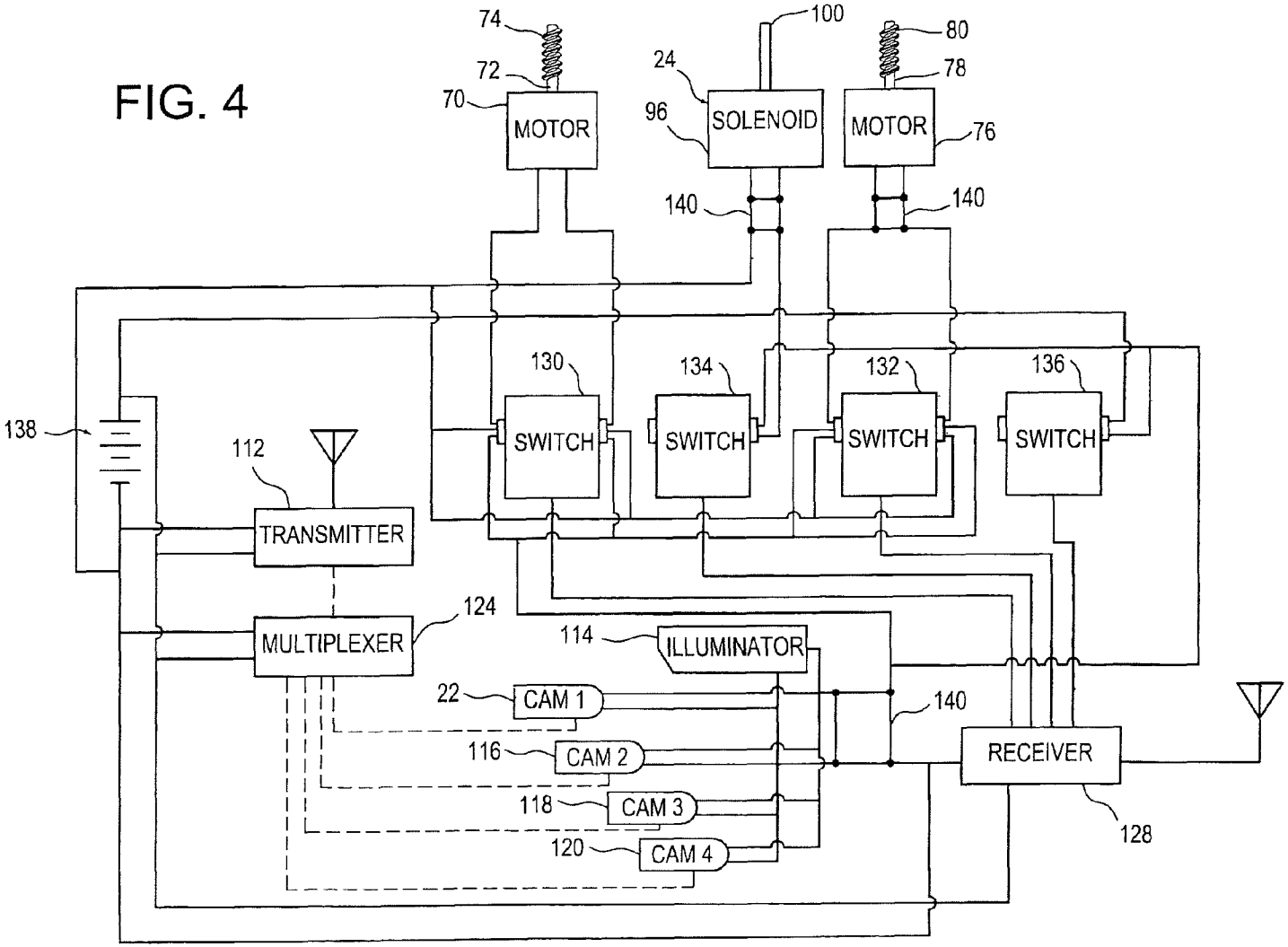
FIG. 4 is a schematic diagram of the electrical circuit of the firearm mount.
Figure 5:
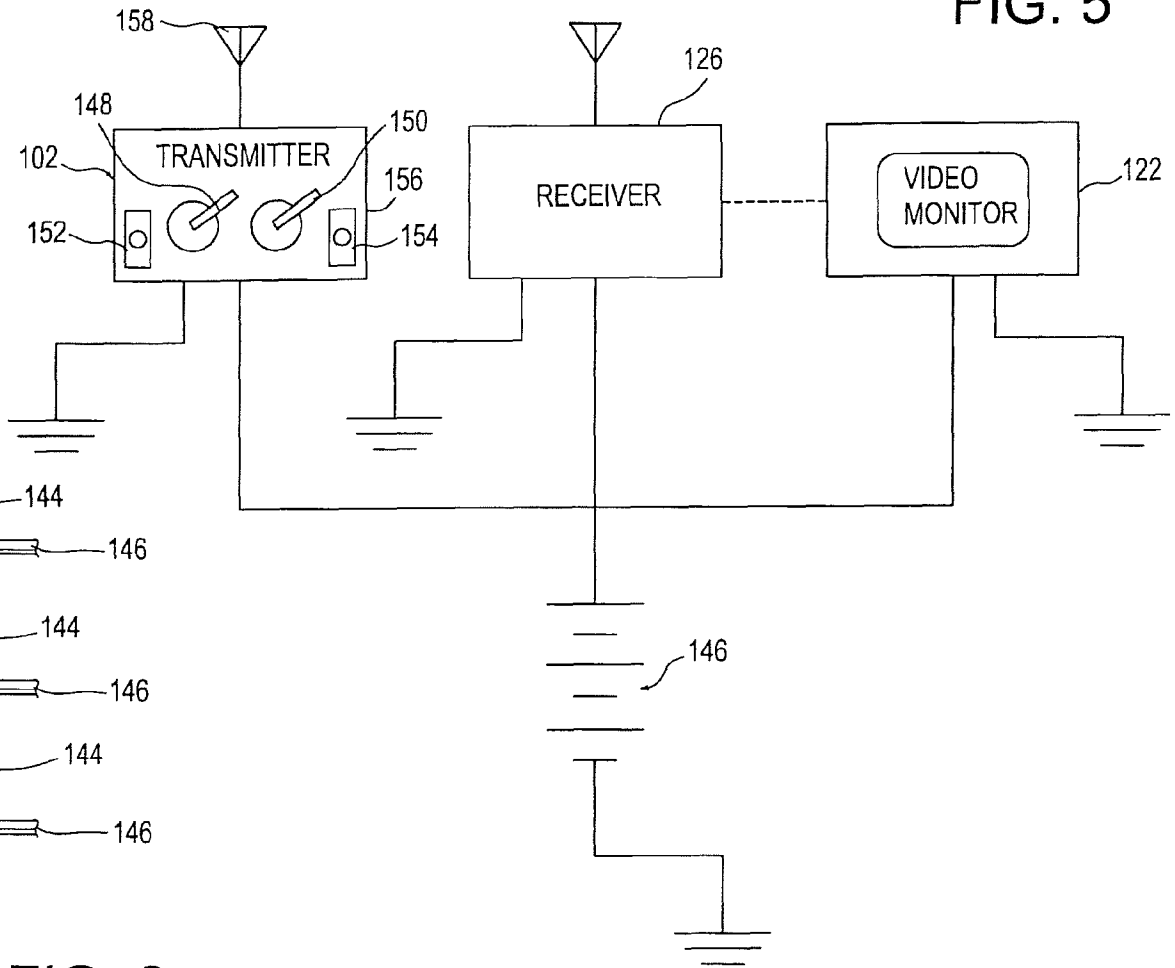
FIG. 5 is a schematic diagram of the electrical circuit of the controller for the firearm mount.

Referring now to the FIGS., a firearm mount is shown at 10. Mount 10 includes a base 12 for positioning in a fixed location on the ground. A rotatable mast 14 projects upwardly from the top of base 12. A cradle 16 for supporting a firearm 18 is secured to the top of mast 14 and rotates with mast 14. The front of cradle 16 can be pitched up and down to elevate the barrel 20 of firearm 18. A video camera 22 is affixed to firearm 18 for generating a video signal stream broadcast to a remote user. A solenoid 24 is affixed to the bottom of firearm 18 for depressing the trigger 26 of firearm 18 thereby discharging firearm 18. The movement of mast 14, cradle 16, and solenoid 24 are accomplished via remote control by the remote user.

Base 12 includes a base plate 28 of rectangular outline. A hole (not shown) is provided in the center of base plate 28 for accommodating mast 14 whose bottom end passes through the hole. A journal bearing 30 is affixed to base plate 28 so as to surround the hole and rotatably fasten mast 14 to base plate 28. Mast 14 rotates freely in bearing 30 about an axis oriented at right angles to base plate 28.

Base 12 has four legs 32 and 34 affixed to the corners of base plate 28. Two legs 32 extend downwardly and forwardly from the front of base plate 28 and two legs 34 extend downwardly and rearwardly from the rear of base plate 28. Although shown to have single piece construction in the drawings, legs 32 and 34 can be segmented to telescope to permit the easy leveling of mount 10 when set on uneven terrain. Legs 32 and 34 can also be made fully detachable from base plate 28 for the compact storage of base 12 when mount 10 is not in use.

Mast 14 features an upright tube 36 whose bottom end is journaled in bearing 30. Mast 14 also has a worm gear 38 (similar in appearance to a spur gear) that is affixed to tube 36 just above bearing 30. To the top end of tube 36 is affixed a hinge 40 that movably connects cradle 16 to mast 14. Hinge 40 has a pair of apertured tabs 42 that extend upwardly from opposite sides of tube 36. A hinge pin 44 extends between, and through, tabs 42 and is free to pivot within tabs 42. A worm gear 46 is affixed to one end of pin 44 extending through one of tabs 42. A connecting rod 48 is affixed to the center of pin 44 between tabs 42 and projects upwardly to a height that is clear of the tops of tabs 42. A cradle support plate 50 is affixed to the top of the connecting rod 48.

A support assembly 52 is affixed to mast 14 between worm gear 38 and hinge 40. Support assembly 52 is T-shaped and includes a longitudinal arm 54 that is affixed to, and extends through, tube 36 such that a forward arm segment 54*a* projects forwardly from tube 36 and a rearward arm segment 54*b* projects rearwardly from tube 36. A lateral arm 56 is affixed at its midpoint to the front of arm segment 54*a*.

Cradle 16 is affixed atop cradle support plate 50. As shown, cradle 16 has a walking beam 58 that is affixed at its midpoint to cradle support plate 50. Walking beam 58 has a length that is substantially equal to that of long-barreled firearm 18. Extending upwardly from walking beam 58 is a pair of firearm support arms 60. One arm 60 is affixed to the forward end of walking beam 58 and the other arm 60 is affixed to the rearward end of beam 58. Arms 60 are substantially identical to one another.

Firearm support arms 60 are Y-shaped so as to catch a portion of firearm 18 in their open crooks. Each of arms 60 includes an upright post 62 that is affixed at its bottom to walking beam 58. A retaining bracket 64 is affixed to each post 62 below the top thereof. Each bracket 64 has a horizontal member 66 that is affixed at its inner end to a post 62 and, also, has a vertical member 68 that is affixed to the outer end of horizontal member 66 remote from post 62. Vertical member 68 extends upwardly from horizontal member 66 parallel to the top of post 62 so as to define each open crook. Although not shown, the top of each crook can be closed to lock firearm 18 therein by threaded fasteners, flexible straps, pivoting jaws, clamps, or other suitable means.

An electric motor 70 is provided to mount 10 for selectively rotating mast 14 and cradle 16 carried thereby. Motor 70 is affixed to base plate 28 adjacent journal bearing 30. Motor 70 has a rotatable drive shaft 72 that extends toward worm gear 38. Drive shaft 72 carries a helically threaded screw or worm 74 that smoothly meshes with worm gear 38. When motor 70 is energized, worm 74 drives gear 38 and rotates mast 14.

Motor 70 is capable of operating with electrical current flowing through it in either of two directions. With electricity flowing through motor 70 in one direction, mast 14 is caused to rotate in a clockwise direction by the rotation of worm 74 on drive shaft 72. With electricity flowing in an opposite direction, however, mast 14 is rotated counterclockwise by worm 74.

An electric motor 76 selectively elevates the front end of cradle 16. As shown, motor 76 is affixed to arm segment 54*b* a short distance from tube 36. Motor 76 has a rotatable drive shaft 78 that extends toward worm gear 46. Drive shaft 78 carries a worm 80 that smoothly meshes with worm gear 46. When motor 76 is energized, worm 80 drives gear 46 so as to elevate cradle 16.

Like motor 70, motor 76 is capable of operating with electrical current flowing through it in either of two directions. With electricity flowing through motor 76 in one direction, the front end of cradle 16 is caused to rise upwardly by the rotation of worm 80. With electricity flowing through motor 76 in an opposite direction, the front end of cradle 16 is lowered by the opposite rotation of worm 80.

Firearm 18 is a semi-automatic rifle, 40 caliber for all-around use. As such, firearm 18 is shown to include a receiver 82 that houses the working parts of the action as well as barrel 20 that projects forwardly from receiver 82 to terminate at a muzzle 84 through which a bullet exits firearm 18. Barrel 20 is a metal tube through which a bullet travels after being fired from a cartridge positioned in receiver 82. Receiver 82 is secured to the front of a stock 86 that serves as a handle for firearm 18. Additional points for handling firearm 18 are provided by a pistol grip 88 that projects downwardly from the bottom of receiver 82 and by a forestock 90 that extends under barrel 20 in front of the receiver 82. A trigger 26 projects downwardly from receiver 82 in front of the pistol grip 88 and is a small lever that is squeezed to start the firing process. A trigger guard 92 surrounds trigger 26 to prevent trigger 26 from being accidentally squeezed or bumped. A magazine 94 is releasably attached to receiver 82 for holding cartridges before they are loaded into the firing chamber.

For use with mount 10, firearm 18 should possess several important characteristics. First, firearm 18 should be self-loading and able to function with a cartridge of adequate power. Also, firearm 18 should be lightweight to permit motors 70 and 76 to pivot and elevate firearm 18 within cradle 16 with minimal strain and maximum speed. Finally, firearm 18 should be simple, strong, and compact thereby permitting trouble-free and hands-free operation for extended periods.

Solenoid 24 converts electrical energy into linear motion so as to move trigger 26. Solenoid 24 has a coil (not shown) made up of many loops of tightly wound wire. When DC current flows through this wire, it creates a strong magnetic flux that flows around the coil and through its center. A cylindrical casing 96 formed of metal surrounds the coil and strengthens the magnetic field. Casing 96 is affixed by a mounting bracket 98 to forestock 90 forward of trigger guard 92. A metallic plunger 100, adapted to slide within the coil, extends rearwardly from casing 96 and has a free end that engages trigger 26. When an electrical current is flowed through the coil, the resulting magnetic flux moves the free end of plunger 100 into trigger 26 with enough force to move trigger 26 and discharge firearm 18.

The response time and the force exerted by plunger 100 on trigger 26 are both directly affected by wattage. Increasing or decreasing the voltage or the electrical current applied to the coil increases or decreases the response time or the applied force. It is noted that the preferred response time of solenoid 24 is very small, approaching zero. Solenoid 24 should depress trigger 26 as quickly as a signal is received from a remote transmitter 102 operated by a user.

An optical sighting device, i.e., scope 104, is mounted atop firearm 18 for aiming. Aiming through scope 104 eliminates much of the complexity of lining up the metallic, open sights 106 and 108 affixed to barrel 20 as a standard feature of firearm 18. With metallic sights 106 and 108, a user is required to line up a potential target with both forward sight 106 and rearward sight 108. With scope 104, however, a user need only line up the crosshairs provided in the optics of scope 104 with a target. Since the optics of scope 104 magnify, a target appears closer allowing a more precise aim.

Scope 104 transmits available light through internal lenses (not shown) to video camera 22. The distance that camera 22 must be to the rear of scope 104 to get a full, clear picture is called "eye relief." Lower-powered scopes will have a larger range of positionings available for a full view. Higher-powered scopes require that camera 22 be precisely distanced from scope 104. Most scopes offer an eye relief measuring between three and three and a half inches.

Video camera 22 is conventional in construction and is affixed to firearm 18 by a mounting bracket 110 extending upwardly from receiver 82. Camera 22 is axially aligned with scope 104 and is positioned within the eye relief of scope 104 such that camera 22 "sees" a focused, magnified image generated by scope 104. If scope 104 was not present on firearm 18, bracket 110 could be moved to reposition camera 22 behind receiver 82 and in alignment with sights 106 and 108. With the focus of camera 22 set on infinity, camera 22 would work well with open sights 106 and 108.

Video camera 22 includes a lens and an imager (neither shown). The lens gathers and focuses light received from scope 104 on the imager. The imager, in turn, converts light into an electronic video signal conveyed to radio transmitter 112. The preferred imager is able to operate when contacted by light having wavelengths in visible and infrared ranges.

For the sake of simplicity, the optical characteristics (aperture size, field of view, shutter speed, etc.) of camera 22 are set at the time of its manufacture. Alternatively, these optical characteristics can be automatically controlled by camera 22. Of course, the addition of electronic optical features to camera 22 for enhancing image quality is a matter of design choice and would add somewhat to the cost of mount 10.

The imager is the "eye" of video camera 22. The lens projects light onto the imager for a predetermined period. The light exposure is converted into an electrical charge which is registered at the imager's output terminals. Then, the imager is reset to start the exposure-process for the next video frame. The electrical charges output by the imager over time comprise the electronic video signal conveyed to transmitter 112.

An infrared illuminator 114 is supported by cradle 16 below firearm 18. Illuminator 114 is a special type of incandescent lamp that is designed to produce radiation in the infrared portion of the electromagnetic spectrum. The wavelengths of this radiation are just a little longer than those of visible light and cannot be seen by the unaided eye. Infrared radiation produced by illuminator 114 is reflected by potential targets back through scope 104 to camera 22 and provides mount 10 with night vision capabilities.

Support assembly 52 carries secondary, video cameras 116, 118 and 120. Camera 116 is affixed to the free end of rearward arm segment **54*b* and points rearwardly to an area behind mount 10. Cameras 118 and 120, however, are affixed to the free ends of lateral arm 56 and point outwardly to areas on the left and right sides of mount 10. Since assembly 52 pivots with tube 36, it is difficult, if not impossible, for someone to approach mount 10 without falling within the field of view of one of cameras 22, 116, 118 and 120. It should be noted that cameras 116, 118 and 120 do not rise and fall as cradle 16 is elevated so that a user need not confront confusing images on monitor 122. Video cameras 116, 118 and 120 are identical to video camera 22**, each pointing in a different direction during use so as to produce unique, electronic video signals, however.

Cameras 116, 118 and 120 are connected in parallel with camera 22 to a multiplexer 124. Electronic video signals from cameras 22, 116, 118 and 120 are directed to multiplexer 124 which combines the multiple signals together into a single video communications signal for broadcast by transmitter 112. Multiplexing divides the capacity of transmitter 112 into several higher-level channels, one for each of the electronic video signals being broadcast.

Multiplexer 124 is connected to a transmitter 112. Transmitter 112 broadcasts the video communications signal generated by multiplexer 124 to a remote receiver 126. The video communications signal is converted by a receiver 126 into a video playback signal that monitor 122 utilizes to simultaneously produce four video images in real time. Each of the video images corresponds to the image seen by a corresponding one of cameras 22, 116, 118 and 120.

Electrical operations signals from transmitter 102 directing the functioning of mount 10 are received by a receiver 128. When such a signal is received, receiver 128 produces an electrical activation signal that activates one of four, servo-operated electrical switches 130, 132, 134 and 136. Switch 130 is of dual-throw type and, when closed, connects motor 70 to battery 138 so as to pivot cradle 16 clockwise or counterclockwise. Switch 132 is also of dual-throw type and, when closed, connects motor 76 to battery 138 to elevate or lower the front of cradle 16. When switch 134 is closed, solenoid 24 is connected to battery 138 so as to discharge firearm 18. Finally, closing switch 136 selectively energizes mount 10 by permitting electrical current flow from battery 138 to all electrical components of mount. With switch 136 in an open position, however, electrical current remains able to flow to receiver 128, multiplexer 124, and transmitter 112 so that the operator is always able to operate switch 136.

Switches 130 and 132 are capable of reversing the direction that electrical current flows through motors 70 and 76. When closed in a "positive" sense, switch 130 causes motor 70 to rotate in a direction that moves cradle 16 in a clockwise direction and, similarly, switch 132 causes motor 76 to rotate in a direction that raises the front end of cradle 16. When closed in a "negative" sense, switch 130 causes motor 70 to move in an opposite direction and turn cradle 16 counterclockwise and, similarly, switch 132 causes motor 76 to lower the front end of cradle 16.

Switch 136 permits a user to set-up mount 10 and, then, turn it off. In a dormant state, mount 10 radiates no heat and is nearly impossible to detect. Furthermore, with mount 10 deenergized, the useful life of battery 138 is extended to its maximum. To reenergize mount 10 and prepare to discharge firearm 18, switch 136 need merely be closed.

Mount 10 is powered by a battery 138. Battery 138 is of lead-acid type with specially designed deep-cycle cells that are not susceptible to degradation due to cycling. Battery 138 is suitable for high-drain, long-life applications over a wide range of temperatures. Battery 138 can easily support the brief, heavy current demands of motors 70 and 76 and cameras 22, 116, 118 and 120, solenoid 24, infrared illuminator 114, multiplexer 124, receiver 128, switches 130, 132, 134 and 136 and transmitter 112. Battery 138 is positioned on the ground in a concealed spot adjacent base 12 along with receiver 128 and transmitter 112.

A battery charger (not shown) is employed with mount 10 to reenergize battery 138 when it becomes depleted by forcing an direct electrical current through it. The characteristics of the charging current depend upon the character of battery 138. The battery charger should monitor voltage, temperature and time under charge for battery 138 so as to determine the optimum charging current. Charging is ended when the monitored parameters indicate that battery 138 is fully charged. Typically, a charger will fast-charge battery 138 up to about 85% of its maximum capacity in less than an hour and, then, switch to trickle charging to top off battery 138 to full capacity over the next several hours. The charger can incorporate an electrical generator driven by an internal combustion engine or a solar array. Alternatively, the charger can be connected directly to an electrical grid through a wall outlet.

Figure 6:
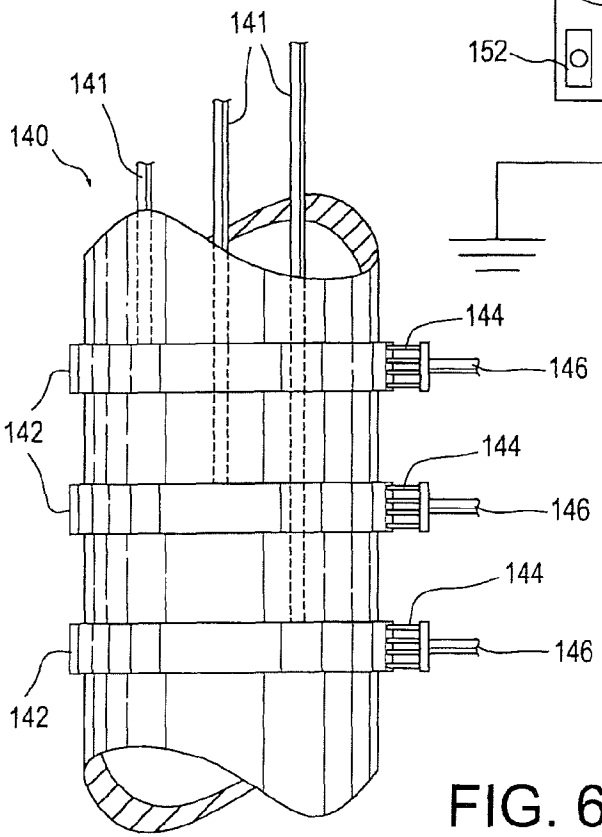
FIG. 6 is a side view of a portion of the electrical connector assembly of the firearm mount.

So that the electrical leads 141 extending to the electrical components (like solenoid 24 and cameras 22, 116, 118 and 120) on cradle 16 do not become tangled as cradle 16 is pivoted, mount 10 is provided with a pivoting electrical connector assembly 140 a portion of which is shown in FIG. 6. As shown, assembly 140 is mounted beneath plate 28 and includes a number of electrically conductive rings 142 affixed in a spaced-apart relationship to the exterior of tube 36. Each of the rings 142 is connected to a lead extending from an electrical component on cradle 16. Each of the rings 142 also turns freely against a respective one of a number of electrical contacts 144 like wire brushes. Each contact 144, in turn, is connected to an electrical lead 146 that completes an electrical circuit to carry out the functions described hereinabove.

Receiver 126 is positioned at a safe location remote from monitor 122. Receiver 126 receives video communications signals from transmitter 112 and converts such into video playback signals capable of playback on monitor 122. Video playback signals include data from cameras 22, 116, 118 and 120. Monitor 122 is powered by an electrical current source such as a battery 146.

The user of mount 10 observes video images generated by cameras 22, 116, 118 and 120 on monitor 122 positioned in a safe place, remote from mount 10. Monitor 122 comprises a LCD, LED, or CRT display. In response to the playback signals from receiver 126, monitor 122 simultaneously produces four video images. The user points cradle 16 and discharges firearm 18 in response to the dangers posed by potential targets seen in the images produced by monitor 122. Monitor 122 is powered by battery 146.

A 4-channel transmitter 102 is used to control mount 10. Transmitter 102 has a pair of control sticks 148 and 150 and a pair of switches 152 and 154 that project forwardly from a hand-held body 156. By moving stick 148 up or down, the user causes cradle 16 to turn clockwise or counterclockwise by energizing motor 70 in a positive or negative sense. Similarly, by moving stick 150 up or down, the front of cradle 16 is selectively elevated. Depressing switch 152 energizes solenoid 24 to fire firearm 18 Finally, moving switch 154 to the "on" position energizes the electrical elements of mount 10 including cameras 22, 116, 118 and 120.

When any input is made by the user, be it moving a stick 148 or 150, moving a switch 152 or 154, a electrical operations signal is broadcast from the antenna 158 projecting upwardly from body 156 and is picked up by receiver 128 wired to mount 10. That signal passes from receiver 128 to switches 130-136 as an activation signal with the end result being a controlled movement of mount 10. Transmitter 102 is powered by battery 146.

The use of mount 10 for aiming and firing firearm 18 is straight forward. First, mount 10 is positioned at a location where a user desires to discharge forearm 18 and monitor 122 is positioned at a safe spot several hundred yards away from mount 10. Next, base 12 is set on the ground and firearm 18 is secured in cradle 16. Then, solenoid 24 and camera 22 are attached to firearm 18. Afterward, battery 138 is connected through assembly 140 to the electrical components of mount 10. Finally, firearm 18 is loaded by clipping cartridge magazine 94 thereto. (Any safety on firearm 18 is also disengaged.) The mount 10 is now ready to aim and discharge firearm 18.

From a location adjacent monitor 122, a user energizes mount 10 by moving transmitter switch 154 to the "on" position. The energized transmitter 112 broadcasts video streams from cameras 22, 116, 118 and 120 that are viewed on monitor 122 such that nothing is able to approach mount 10 from any direction unobserved. If the user, desires to move firearm 18 clockwise, say 90.degree. from its starting position, he need only press control stick 148 on transmitter upwardly for a moment with confirmation of the new positioning being viewed on monitor 122. Similarly, it the user desires to move barrel 20 of firearm 18 upwardly, he need only press control stick 150 upwardly for a moment. If the desired orientation or inclination of barrel 20 is not immediately reached, the user need only repeat the inputs applied to sticks 148 and 150. Confirmation of adequate movement of barrel 20 is achieved by observing the video images from cameras 22, 116, 118 and 120 produced by monitor 122.

After carefully positioning firearm 18 using control sticks 148 and 150, a target will appear in the crosshairs of scope 104 seen on the video stream from camera 22. At this time, a user discharges firearm 18 by moving switch 152 on transmitter 102. If the target is missed, the firing step is repeated as often as necessary and as often as magazine 94 permits. A moving target can be tracked while firing simply by making appropriate inputs with control sticks 148 and 150 as switch 152 is being repeatedly moved.

Care must be exercised to ensure that a user not shoot himself while using mount 10. Perhaps the most important step that can be taken in this regard is moving switch 154 to the "off" position when approaching mount 10. With mount 10 in a dormant state, firearm 18 can be easily checked and reloaded. After use is complete, mount 10 is easily disassembled for transport and compact storage.

Mount 10 permits a user to get very close to a target, like a game animal with acute senses, and make an effective shot without the expenditure of great effort or the need for luck. All that is required is patience for a game animal to come within the field of view of cameras 22, 116, 118 and 120. Since firearm 18 is aimed while looking through scope 104, just as if the user was personally holding firearm 18, the user of mount 10 seldom misses a target with a shot made within the effective range of firearm 18.

While my firearm mount 10 has been described with a high degree of particularity, it will be appreciated by those skilled in the art that modifications can be made to it. For example, radio-controlled, variable resistors can be added between battery 138 and motors 70 and 76 to serve as speed controllers making it possible to move cradle 16 at a range of speeds. Slower speeds can provide added stealth while fast speeds make the tracking of fast moving targets easy. Therefore, it is to be understood that the present invention is not limited to mount 10, but encompasses any and all mounts within the scope of the following claims.

What is claimed is:

1. A firearm mount, comprising:

a base for positioning on a supporting surface;

a mast being rotatably fastened said base plate:

a cradle for supporting a firearm, said cradle including:

a remotely controlled solenoid adapted for mounting on a firearm carried by said cradle, said solenoid having an extensible plunger for moving a trigger of said firearm for discharging said firearm;

a first video camera adapted for mounting on said firearm, said first video camera producing a first electronic video signal;

a first transmitter being connected to said first video camera for broadcasting said first electronic video signal to a remote first receiver;

at least one second video camera being carried by said mast and facing in a different direction of said first video camera for producing at least one second electronic video signal;

said first transmitter being connected to said at least one second video camera for broadcasting the at least one second electronic video signals to the remote first receiver;

a first remotely controlled motor being affixed to said base, said first motor having a first rotatable drive shaft extending therefrom;

a second, remotely controlled motor being carried by said mast, said second motor having a second rotatable drive shaft extending therefrom.

2. The firearm mount according to claim 1 further comprising a second receiver, being connected to said first motor and said second motor, for receiving electrical operations signals from a second transmitter and for selectively energizing said first motor and said second motor in response to the electrical operations signals.

3. The firearm mount according to claim 1 wherein said first video camera has night vision capability and said firearm mount further comprises an infrared illuminator being affixed to said walking beam for producing infrared radiation that, when reflected by a target, is detectable by said first video camera.

4. The firearm mount according to claim 1 further comprising:

a battery for powering said first motor, said battery being positioned adjacent said base; and, a pivoting electrical connector assembly being secured to the bottom of said tube and being connected in series between said first motor and said battery.

5. The firearm mount according to claim 1, said base for positioning on a supporting surface further comprising:

a base plate having a hole therein;

a plurality of legs being affixed to, and extending downwardly from, said base plate; and a journal bearing being affixed to said base plate and surrounding said hole.

6. The firearm mount according to claim 5, said mast further comprising:

an upright tube having a top rising above said base plate and a bottom extending through said journal bearing;

a first worm gear being affixed to said tube adjacent said journal bearing;

a hinge being affixed to the top of said tube.

7. The firearm mount according to claim 6, said hinge further comprising:

a pair of apertured tabs extending upwardly from said tube;

a hinge pin extending between, and through, said tabs, said hinge pin being free to pivot within said tabs;

a connecting rod being affixed to, and extending upwardly from, said hinge pin between said tabs; and a second worm gear being affixed to said hinge pin remote from said connecting rod.

8. The firearm mount according to claim 7, said cradle further comprising:

a walking beam being affixed at the middle thereof to said connecting rod;

a pair of firearm support arms being affixed to, and extending upwardly from, said walking beam at spaced-apart locations.

9. The firearm mount according to claim 8, further comprising:

a second worm being affixed to said second rotatable drive shaft so as to smoothly mesh with said second worm gear whereby the rotation of said second rotatable drive shaft pivots said walking beam on said hinge.

10. The firearm mount according to claim 6, further comprising:

a first worm being affixed to said first rotatable drive shaft so as to smoothly mesh with said first worm gear whereby the rotation of said first rotatable drive shaft rotates said first worm gear and said mast.

11. A method for controlling a remote firearm mount, the method comprising:

mounting a firearm on a cradle;

mounting a first video camera on said firearm;

producing a first electronic video signal from said first video camera;

mounting at least one second video camera on a tube carrying said cradle, said at least one second video camera facing in a different direction of said first video camera;

producing at least one second electronic video signal from said at least one second video camera;

broadcasting said first electronic video signal and said second video signal to a remote, first receiver;

remotely controlling at least one motor affixed to said cradle;

remotely controlling at least one second motor affixed to said tube;

remotely controlling a solenoid mounted on said firearm, said solenoid having an extensible plunger for moving a trigger of said firearm;

discharging said firearm by activating said solenoid.

* * * * *